United States Patent [19]

Maatje et al.

[11] 4,198,678

[45] Apr. 15, 1980

[54] VEHICLE CONTROL UNIT

[75] Inventors: Henri Maatje, Oslo, Norway; Richard Spannagel, Stuttgart, Fed. Rep. of Germany

[73] Assignee: International Standard Electric Corporation, New York, N.Y.

[21] Appl. No.: 869,724

[22] Filed: Jan. 16, 1978

[30] Foreign Application Priority Data

Jan. 19, 1977 [DE] Fed. Rep. of Germany ..... 2701924

[51] Int. Cl.[2] ..... G06F 15/50; B61L 27/04

[52] U.S. Cl. ..... 364/426; 364/101; 371/68

[58] Field of Search ..... 369/436, 101, 424, 426; 235/307, 303.3, 303.1; 246/63 R, 63 A, 63 C

[56] References Cited

U.S. PATENT DOCUMENTS

| | | | |
|---|---|---|---|
| 3,517,174 | 6/1970 | Ossfeldt | 235/307 |
| 3,810,119 | 5/1974 | Zieve et al. | 235/307 |
| 3,978,327 | 8/1976 | Huber | 235/307 |
| 4,012,717 | 3/1977 | Censier et al. | 235/307 |
| 4,015,804 | 4/1977 | Dobler et al. | 364/436 |
| 4,030,074 | 6/1977 | Giorcelli | 235/307 |
| 4,032,757 | 6/1977 | Eccles | 235/307 |

FOREIGN PATENT DOCUMENTS

| | | | |
|---|---|---|---|
| 2258917 | 6/1973 | Fed. Rep. of Germany | 235/307 |
| 2710466 | 9/1977 | Fed. Rep. of Germany | 235/307 |

OTHER PUBLICATIONS

Costa et al.: Sao-Paulo Metro E-W Line Innovations, IEEE Industry Applications Society Annual Meeting, Oct. 2-6, 1977, p. 1106, last paragraph in the first column of interest, pp. 1105-1109.

*Primary Examiner*—Felix D. Gruber

*Attorney, Agent, or Firm*—John T. O'Halloran; Alfred C. Hill

[57] ABSTRACT

A vehicle control unit for a short-distance traffic system is disclosed wherein a plurality of vehicles are controlled from a center. Each vehicle carries at least two on-board computers each of which process the control commands coming from the center to provide commands to on-board units and compiles telegrams to the center concerning the condition, location and speed of the vehicle in response to information from the on-board units. Both computers perform the necessary processing independently of each other. A comparator ensures that commands to the on-board units and the compiled telegrams are not sent until this information is received in identical form from both computers. Each computer delivers life signals at regular intervals to an associated emergency brake circuit, which initiate emergency braking if life signals from the associated one of the computers are not received within a given period of time. In the event of a malfunction in a computer, a standby computer or a pair of standby computers is put in action.

8 Claims, 4 Drawing Figures

VEHICLE CONTROL UNIT

BACKGROUND OF THE INVENTION

The present invention relates to a control unit for track-bound vehicles which are capable of exchanging data telegrams with a center via transmitting and receiving equipment.

U.S. Pat. No. 4,015,804, whose disclosure is incorporated herein by reference, which has a Claim for Priority based on German Published patent application DT-OS 2,423,590 discloses an hierarchically organized vehicle control system wherein a plurality of vehicles are controlled from command and control centers. This necessitates vehicle on-board control equipment which must perform a large number of different functions with fail-safety.

Such on-board control equipment has so far been developed specifically for continuous (long-haul) automatic train control, and as a rule, a special, fail-safe circuit has been provided for each function.

Such a solution has little flexibility and becomes very expensive if the number of functions to be performed by the control equipment increases. This is the case, for example, in short-distance traffic systems such as the one described in the above-cited U.S. Patent. In the demand-controlled system described there, an increase in the cost of the vehicle control unit has particularly unfavorable consequences since in the interest of efficient demand control, the use of many small vehicle units instead of few large ones considerably increases the share of the vehicle control units in the total cost of the system.

SUMMARY OF THE INVENTION

An object of the present invention is to provide a less expensive, more flexible vehicle control unit which is more efficient with unchanged safety, thereby fulfilling a prerequisite for an economically efficient, demand-controlled, short-distance traffic system.

The control unit according to the invention is characterized in that control commands from the control center is processed to provide commands to each of a plurality of on-board units and messages are compiled to be transmitted to the control center concerning the condition, locations, and speeds of the vehicles from information received from each of the plurality of on-board units by two on-board computers in each vehicle independently of each other. The commands to the plurality of on-board units and the messages to the control center are sent provided identical commands to the plurality of on-board units and identical messages to the control center are provided by the two computers. Both of the computers also deliver life signals at regular intervals to an associated emergency brake circuits each of which can initiate emergency braking if life signal its associated one of the computers are not received within a given period of time. This permits a large number of different tasks to be performed with fail-safety. It is possible to make changes in the task catalogue within a short time by changing the computer programs, and no alterations have to be made in the equipment. In addition, advantage is taken of the recent favorable price trend in the microcomputer market.

A development of the control unit according to the invention is characterized in that for comparing the output signals of the two computers, a known comparator is provided whose operation is automatically checked from time to time by intentional falsification of one of the computer output signals to be compared. Thus, processing errors are detected and any failure of the comparator is discovered after a short time.

Another development of the control unit according to the invention is characterized in that an emergency brake circuit is associated with each computer. Each of the emergency brake circuits including a solenoid valve, a relay, and a tuned transformer to whose primary side is applied an alternating voltage from a series circuit including a flip-flop, a band-pass filter, and an amplifier. The input of the series circuit is a sequence of voltage pulses (life signal) provided by the one of the computers. The secondary voltage of the transformer, following rectification in a rectifier circuit, causes the relay to operate, and that a make contact of the relay in series with the winding of the solenoid valve, which is open in the deenergized condition, is connected in a closed circuit.

This ensures that even if the on-board supply system fails, i.e., when no comparison can be performed, the emergency brakes will be applied. In addition, the selectivity of the emergency brake circuit makes certain that only a particular pulse sequence, not any interference, can prevent the application of the emergency brakes.

A further development of the control unit according to the invention is characterized in that means are provided which, upon detection of an error by the comparator, disconnects the transmitting equipment and all computer-controlled on-board units from the computers, initiate a repetition of the arithmetic operation of the computers causing the error and, if the repetition has led to an erroneous output, also, initiate emergency braking. Thus, systematic errors lead to emergency braking, while sporadic errors, which may be caused by electro-magnetic interference, are rendered ineffective, which contributes to a smooth ride.

Another development of the control unit according to the invention relates to the protected transfer to the transmitting equipment of the data telegrams created by the computers and is characterized in that for delivery of the data telegrams addressed to the center, both computers are connected to the transmitting equipment via separate data lines, that the data line of one of the computers can be connected to either a regular or an inverting output of the one of the computers by means of a changeover switch controlled by at least one of the computers, that the transmitting equipment includes an equivalence check circuit which allows the data telegrams to be transmitted from the computers only if these data telegrams have been received in equivalent form from both computers, and that for checking whether the equivalence check circuit is functioning correctly, the controllable changeover switch is switched from time to time to verify whether the equivalence check circuit detects the absence of equivalence.

Other developments are characterized in that each of the computers is controlled by a different one of two clock generators which are directly coupled together for synchronization of the clock frequency, and that instead of a comparator following the computers, a data line is provided between the computers over which the two computers exchange their results or output signals and over which the comparison of the results obtained in the two computers is carried out. Thus the computers no longer use any joint hardware, whereby the probability of errors which occur simultaneously at both computer outputs and cannot, therefore, be detected by comparison is greatly reduced. In addition, the comparison of the computer results is performed twice, and the need for the external comparator is eliminated.

Another development of the control unit according to the invention is characterized in that for creating the data telegrams and control commands, the storage and arithmetic units in the two computers are connected in series in different order, and that the comparison of the results is not performed unitl at the end of each computer cycle. This is implemented in practice by the use of different computer programmes and allows processing errors based on program errors to be immediately detected, too.

A further development of the control unit according to the invention is designed to permit the vehicle to travel on in the event of a failure of one computer, thus preventing a defective vehicle from blocking a track section. This development is characterized in that, in addition to the two computers for vehicle control, each vehicle carries a third computer which, in the event of a failure of one of the computers used for vehicle control, is automatically put into operation in place of the defective computer.

An alternative to the foregoing development of the control unit according to the invention is characterized in that, instead of a third computer, two additional computers stand ready on each vehicle which, in the event of a failure of one or both computers used for vehicle control, are automatically put into operation in place thereof and monitor each other in the same way as the computers originally used for vehicle control. Compared to the switchover of a single stand-by computer, this solution has the advantage of simpler switchover.

A last development of the control unit according to the invention is characterized in that AND gates are provided which do not allow an interrupted delivery of life signals by the computers to the emergency brake circuits to resume again until synchronization between the two computers intended to take over the vehicle control has been established, that is until the comparison of the computer results or output signals shows agreement, and until at least two telegrams have been received from the center. This ensures that after switchover of one or both computers, a vehicle cannot resume its movement until two on-board computers work correctly and in synchronism and until safe information on the next destination is available.

BRIEF DESCRIPTION OF THE DRAWING

Above-mentioned and other features and objects of this invention will become more apparent by reference to the following description taken in conjunction with the accompanying drawing in which.

DESCRIPTION OF THE PREFERRED EMBODIMENTS

Figure 1:
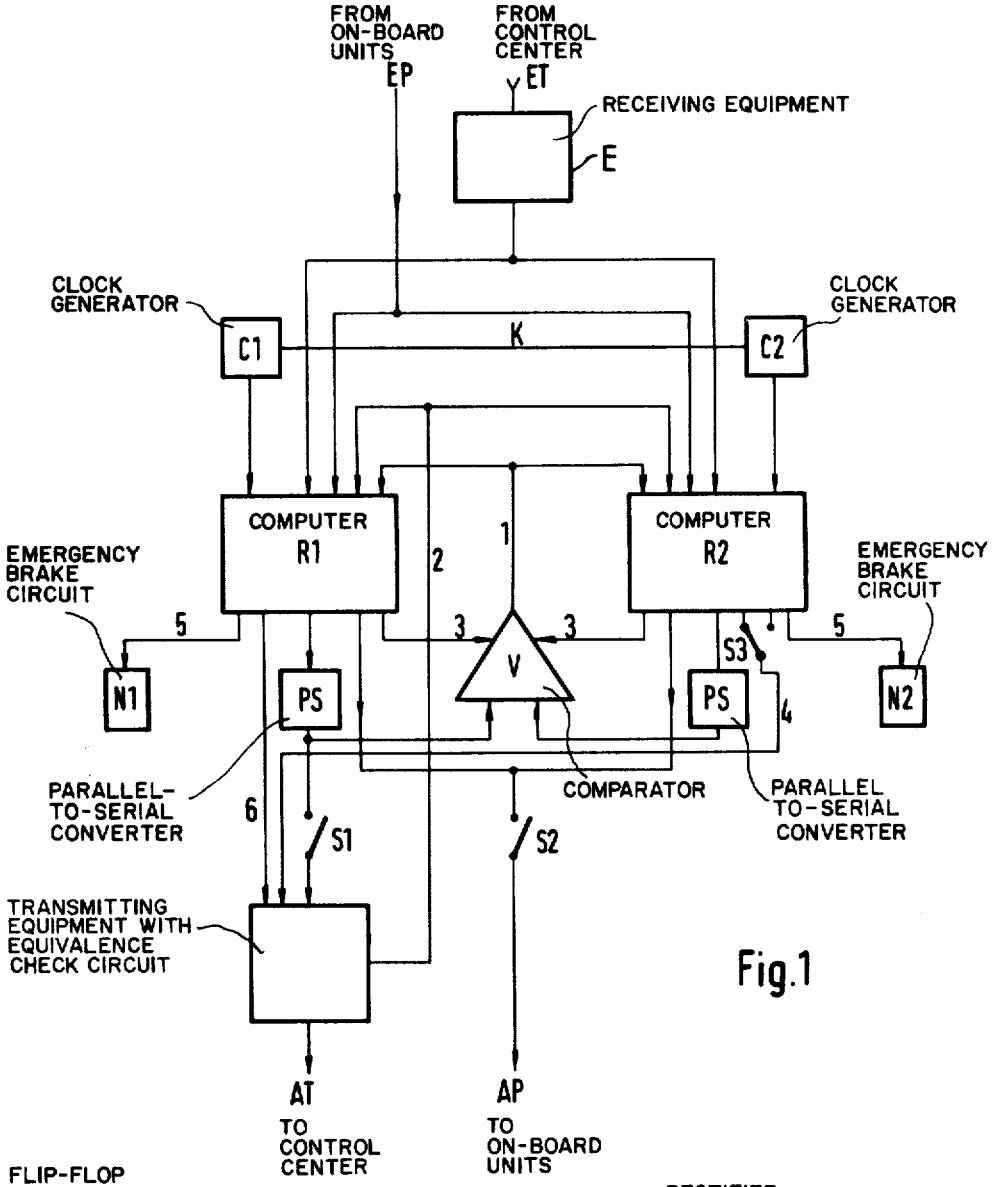
FIG. 1 is a block diagram of a control unit according to the principles of the present invention.

The control unit shown in FIG. 1 contains two computers R1 and R2, transmitting equipment S, receiving equipment E, and comparator V. Also shown are two clock generators C1 and C2 two emergency brake circuits N1 and N2 two external parallel-to-serial converters PS, two disconnecting switches S1 and S2 and one changeover switch S3. Computers R1 and R2 may be an ITT 1650-65 stored-program digital computer as described in the avove-cited U.S. patent.

Both computers R1 and R2 receive data telegrams from a central control center via an input ET and receiving equipment E. Via an input EP, both computers R1 and R2 receive data from various on-board units, such as the position-determining and speed-measuring system, the propulsion and brake control units, the door-closing unit, and the automatic coupling unit.

From the received data telegrams, the two computers R1 and R2, independently of each other, create control commands for the on-board units which, following a comparison, are delivered via an output AP to the on-board units. From the data of the on-board units, both computers R1 and R2 compile data telegrams for the center which, after establishment of identity by a comparison, are transmitted to the center via an output AT.

All processing operations of the computers are performed in parallel and in synchronism. This is ensured by the clock generators C1 and C2, which are synchronized via a direct coupling K. The output signals of computers R1 and R2 are compared in comparator V on a serial-by-bit basis. In case of disagreement, computers R1 and R2 are notified via a connection 1. As a result, transmitting equipment S and all on-board units are disconnected from computers R1 and R2 by means of switches S1 and S2 controlled by computers R1 and R2, and the entire arithmetic process which led to the false output signal is repeated. This is done with the same output data which are still stored in the input storages of the computers at that time. If, after the repetition, comparator V again signals disagreement of the results, the two computers will cause emergency brake circuits N1 and N2 to initiate emergency braking. If comparator V detects no error during the repetition of an arithmetic process, the transmitting equipment and the on-board units will be connected to the outputs of the computers again, and normal operation will continue.

If comparator V fails, this will be noticed with the first intentionally falsified computing result and communicated to computers R1 and R2. The latter then cause the check to be repeated with transmitting equipment S and the on-board units disconnected. If comparator V does not work during the repetition, the emergency brakes will be applied; otherwise, normal operation will be resumed.

To eliminate transmission errors on the way to transmitting equipment S, both computers R1 and R2 are connected to transmitting equipment S, and a telegram received from computer R1 is delivered only if an equivalence check circuit transmitting equipment S determines that the telegram received from computer R2 over the line 4 is equivalent to the telegram received from computer R1. The equivalence check circuit may be a pair of registers each receiving the compiled data telegrams from a different one of computers R1 and R2 and logic circuitry to check the equivalency of the bits stored in the two registers. To check whether this equivalence check circuit is functioning properly, a non-equivalent telegram pair is sent to transmitting equipment S at regular intervals by switching switch S3 under control of computers R1 and R2. For safety reasons, the regular telegram for this check must not be sent over the channel used for the delivery of valid telegrams. Therefore, switch S1 is opened, and a separate test line 6 is used to transfer the data telegram created by computer R1 to transmitting equipment S. This check, too, is repeated if the equivalence check circuit has turned out to be faulty, and only if the fault indication is repeated will the emergency brakes be applied.

Figure 2:
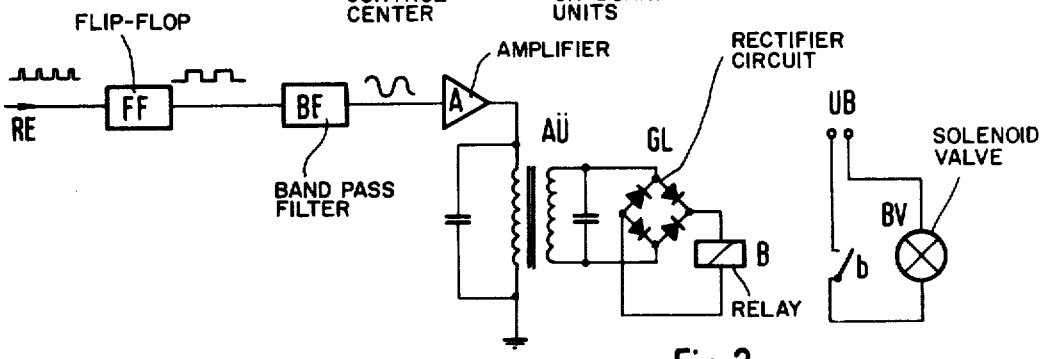
FIG. 2 is a block diagram of each of the emergency brake circuits of FIG. 1.

An emergency brake circuit is shown in FIG. 2. It contains a solenoid valve BV fed via a make contact b of a relay B, a flip flop FF, a band pass filter BF, an amplifier A, a tuned transformer AU, and a rectifier circuit GL.

Since the emergency brake must function even in the event of a complete power failure, solenoid valve BV must be included in a closed circuit. Also inserted in this closed circuit is make contact b of relay B whose energization is dependent on the presence of a life signal from the associated one of computers R1 and R2. The life signal, in this case a pulse delivered at regular intervals, is fed into the emergency brake circuit through an input RE and converted into a square-wave voltage by flip flop FF and into a nearly sinusoidal alternating voltage by band pass filter BF. Having been amplified in the amplifier A, the alternating voltage energize the primary circuit of tuned transformer AU. The voltage induced on the secondary side of transformer AU is rectified by rectifier circuit GL and drives current through the winding of relay B. If the life signal of the computer fails to appear, relay B will become deenergized and open its make contact b so that the closed circuit current, which keeps solenoid valve BV closed, will be interrupted. As a result, solenoid valve BV will open and the emergency brake will be actuated. Since such emergency brake circuit is associated with both computers, any failure of either computer will be noticed.

Figure 3:
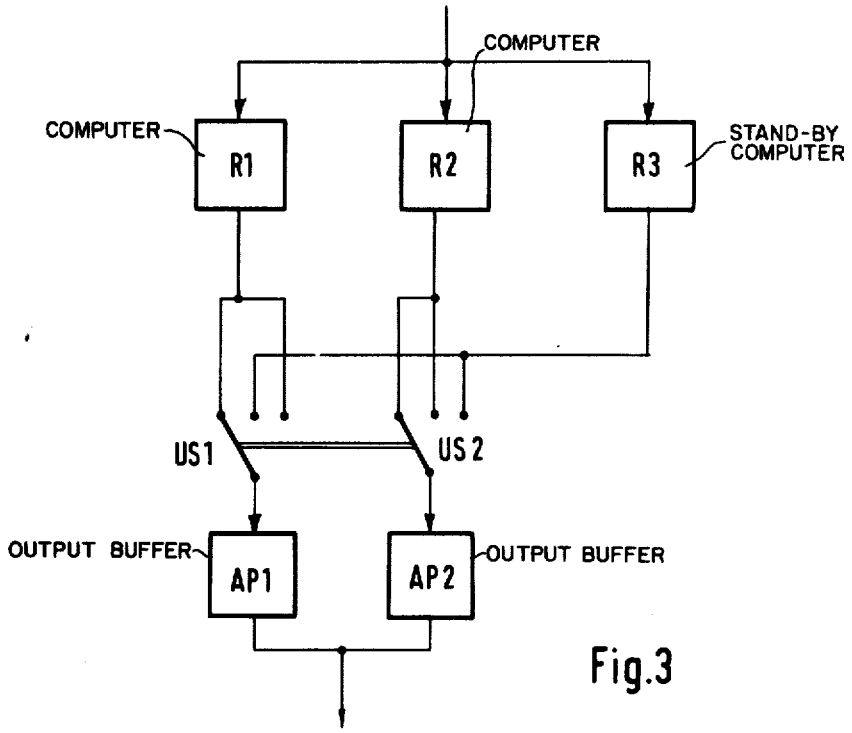
FIG. 3 is a block diagram of the switchover arrangement when one standby computer is employed.

FIG. 3 shows the switchover arrangement when a third computer is used as a standby computer. Besides two vehicle control computers R1 and R2 and their associated circuitry of FIG. 1 the arrangement contains a stand-by computer R3, output buffers AP1 and AP2, and switches US1 and US2 which are shown here as changeover contacts for simplicity but in reality are semiconductor switches and switch at least 15 connections each.

The interface where a defective computer is disconnected and the standby computer is connected lies between computer and output buffer. Switches US1 and US2 are coupled and are actuated together at the same time by computers R1 and R2. If a failure occurs in computer R1, for example, an emergency brake application will follow. Simulaneously with the initiation of emergency braking, switches US1 and US2 are stepped on. Thus, computer R3 is connected instead of computer R1, and normal operation can be resumed. If computer R2 was defective, stepping the switches US1 and US2 to the next position is of no use yet. Only when the switches are stepped on again will the combination of the two intack computers R1 and R3 be established.

Figure 4:
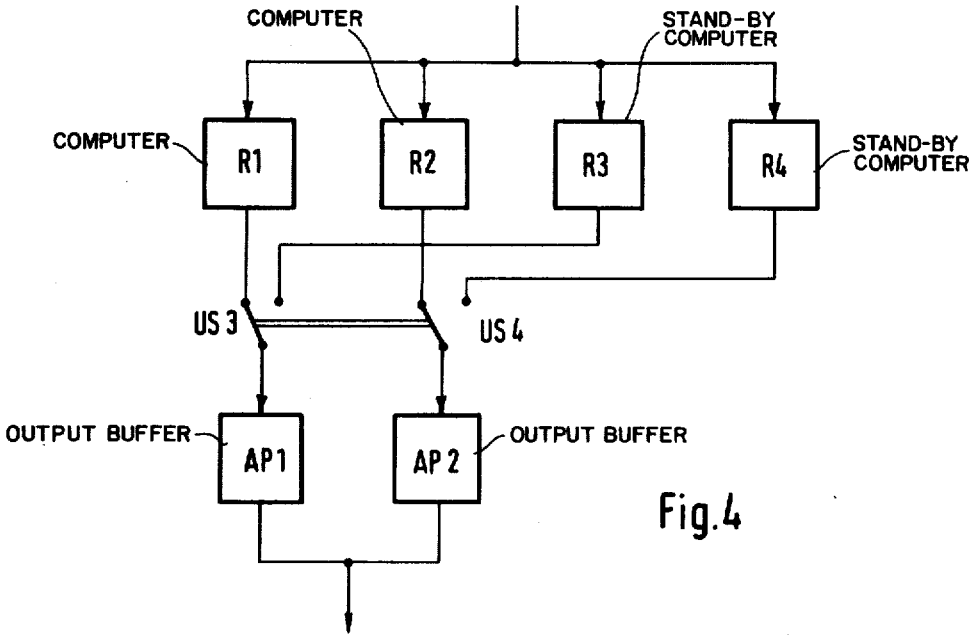
FIG. 4 is a block diagram of the switchover arrangement when two standby computers are employed.

FIG. 4 shows the switchover arrangement when a pair of standby computers is used. Connected in parallel with the computers R1 and R2 at the input end are two stand-by computers R3 and R4. Two switches US2 and US4 have only two positions and are operated together with the emergency brake from computers R1 and R2. If one of the computers R1 and R2 becomes defective, switches US3 and US4 will be changed over and computers R3 and R4 will take over control of the vehicle.

While we have described above the principles of our invention in connection with specific apparatus it is to be clearly understood that this description is made only by way of example and not as a limitation to the scope of our invention as set forth in the objects thereof and in the accompanying claims.

What is claimed is:

1. A control unit for a track-bound vehicle capable of exchanging data telegrams with a control center via transmitting and receiving equipment comprising:

two computers coupled to said receiving equipment, said transmitting equipment and on-board units, each of said two computers delivering as an output a life signal at regular intervals and each of said two computers, independent of each other, process data telegrams received by said receiving equipment to generate control commands for said on-board units and compile data telegrams concerning the condition, location and speed of said vehicle for said control center from data received from said on-board units, said control commands being delivered to said on-board units and said compiled data being transmitted to said control center only when said control commands and said compiled data telegrams produced by each of said two computers are identical;

a comparator coupled to each of said two computers to compare said control commands and said compiled data telegrams from each of said two computers to determine whether they are identical, operation of said comparator being automatically checked from time to time by intentionally falsifying said control commands and said compiled data telegrams delivered by one of said two computers;

two clock generators each coupled to and controlling a different one of said two computers;

a direct connection between said two clock generators for synchronization of the clock frequency thereof; and two emergency brake circuits each coupled to a different one of said two computers responsive to said life signals to initiate emergency braking if said life signals from the associated one of said two computers is not received within a given period of time.

2. A control unit according to claim 1, wherein each of said emergency brake circuits include a solenoid valve in a closed circuit, a relay having a winding and a make contact in said closed circuit with said solenoid valve, said contact being open in a deenergized state of said relay, a tuned transformer having a primary winding and a secondary winding, a rectifier circuit coupled between said secondary winding and said relay winding, a flip flop coupled to the associated one of said two computers responsive to said life signal therefrom in the form of a series of pulses, a band pass filter coupled to said flip flop to to provide an alternating voltage, and an amplifier coupled between said band pass filter and said primary winding to couple an amplified version of said alternating voltage to said transformer, said relay being energized, said contact being closed and an emergency brake being inoperative during the presence of said series of pulses.

3. A control unit according to claim 2, further including switching means controlled by said two computers to disconnect said transmitting equipment and said on-board units from said two computers when said comparator detects an error, said two computers then initiating a repetition of the operation thereof that resulted in said detected error and if said repetition results in an erroneous output signal from said two computers emergency braking is initiated.

4. A control unit according to claim 1, further including switching means controlled by said two computers to disconnect said transmitting equipment and said on-board units from said two computers when said comparator detects an error, said computers than initiating a repetition of the operation thereof that resulted in said detected error and if said repetition results in an erroneous output signal from said two computers emergency braking is initiated.

5. A control unit according to claim 4, wherein one of said two computers is directly connected to said transmitting equipment for coupling said compiled data telegrams thereto, and a changeover switch controlled by said two computers to couple one of said compiled data telegrams and an inverted compiled telegram from the other of said two computers to said transmitting equipment, said transmissing equipment including an equivalence check circuit which permits transmission of said compiled data telegrams only if said compiled data telegrams are received from both of said two computers in equivalent form, said equivalence check circuit being checked for correct operation by periodically switching said changeover switch to couple said inverted compiled telegram to said equivalence check circuit to verify whether said equivalence check circuit detects absence of equivalence.

6. A control unit according to claim 1, wherein one of said two computers is directly connected to said transmitting equipment for coupling said compiled data telegrams thereto, and a changeover switch controlled by said two computers to couple one of said compiled data telegrams and an inverted compiled telegram from the other of said two computers to said transmitting equipment, said transmitting equipment including an equivalence check circuit which permits transmission of said compiled data telegrams only if said compiled data telegrams are received from both of said two computers in equivalent form, said equivalence check circuit being checked for correct operation by periodically switching said changeover switch to couple said inverted compiled telegram to said equivalence check circuit to verify whether said equivalence check circuit detects absence of equivalence.

7. A control unit according to claim 1, further including a third computer carried by said vehicle identical to each of said two computers coupled to said receiving equipment and said on-board units to generate said control commands and to compile said data telegrams for said control center; and switching means controlled by said two computers in response to a failure of one of said two computers to automatically replace said failed one of said two computers by said third computer.

8. A control unit according to claim 1, further including two additional computers carried by said vehicle identical to said two computers coupled to said receiving equipment and said on-board units to generate said control commands and to compile said data telegrams for said control center; and switching means controlled by said two computers in response to a failure of at least one of said two computers to automatically replace said two computers by said two additional computers.

* * * * *